US005603459A

United States Patent [19]

Gearing et al.

[11] Patent Number: 5,603,459

[45] Date of Patent: Feb. 18, 1997

[54] CHIPPER-SHREDDER WITH ENHANCED USER FEATURES

[75] Inventors: Thomas W. Gearing, Wauwatosa; Andrew W. Haver, West Bend, both of Wis.

[73] Assignee: The Patriot Company, Milwaukee, Wis.

[21] Appl. No.: 290,547

[22] Filed: Aug. 15, 1994

[51] Int. Cl.[6] ..... B02C 13/02

[52] U.S. Cl. ..... 241/56; 241/101.78

[58] Field of Search ..... 241/56, 107.78, 241/189.1, 194

[56] References Cited

U.S. PATENT DOCUMENTS

| | | | |
|---|---|---|---|
| 522,945 | 7/1894 | Schultz . | |
| 750,329 | 1/1904 | Windingstad . | |
| 810,204 | 1/1906 | Harrison et al. . | |
| 1,211,566 | 1/1917 | Fortney . | |
| 1,573,040 | 2/1926 | Crites . | |
| 1,975,486 | 10/1934 | Reschke | 83/11 |
| 2,247,665 | 1/1941 | Ottersland | 144/176 |
| 2,625,332 | 1/1953 | Rogers et al. | 241/300 |
| 3,229,923 | 1/1966 | Conley et al. | 241/253 |
| 3,240,247 | 3/1966 | Lautzenheiser | 146/107 |
| 3,627,010 | 12/1971 | Rueff | 146/117 R |
| 3,682,400 | 8/1972 | Smith | 241/56 |
| 3,700,177 | 10/1972 | Person | 241/36 |
| 3,712,353 | 1/1973 | Ferry | 241/27 |
| 3,817,462 | 6/1974 | Hamlin | 241/101.7 |
| 3,963,183 | 6/1976 | Paulsen | 241/88.4 |
| 4,544,104 | 10/1985 | Carlsson | 241/57 |
| 4,824,034 | 4/1989 | Baker | 241/101.2 |
| 4,834,302 | 5/1989 | Baker | 241/92 |
| 4,875,630 | 10/1989 | Carlson | 241/56 |
| 4,951,882 | 8/1990 | Ober | 241/55 |
| 5,018,672 | 5/1991 | Peck et al. | 241/37.5 |
| 5,085,376 | 2/1992 | Litchenburg | 241/56 |
| 5,102,056 | 4/1992 | Ober | 241/55 |
| 5,156,345 | 10/1992 | Baker | 241/56 |
| 5,381,970 | 1/1995 | Bold et al. | 241/55 |
| 5,385,308 | 1/1995 | Gearing et al. | 241/101.7 |

FOREIGN PATENT DOCUMENTS 2727164 12/1977 Germany .

OTHER PUBLICATIONS

Trade literature Troy–Built Chipper/Vac (No Date Given).

*Primary Examiner*—John M. Husar
*Attorney, Agent, or Firm*—Jansson & Shupe, Ltd.

[57] ABSTRACT

A new chipper-shredder machine has a number of features selected with the user in mind. Such machine includes a laminated lightweight fan and comminuting assembly to accommodate the characteristics of an electric drive motor. The assembly drive shaft has exposed wrench "flats" for reverse-rotating such assembly to remove clogging obstructions. In recognition of the possibility of user abuse or negligence which might cause breakage of grinding rotor parts, such rotor is arranged and configured to direct broken parts away from the machine prime mover and toward the fan chamber. And the machine fan discharge port has increased area for improved air flow and reduced clogging.

5 Claims, 11 Drawing Sheets

FIG. 3
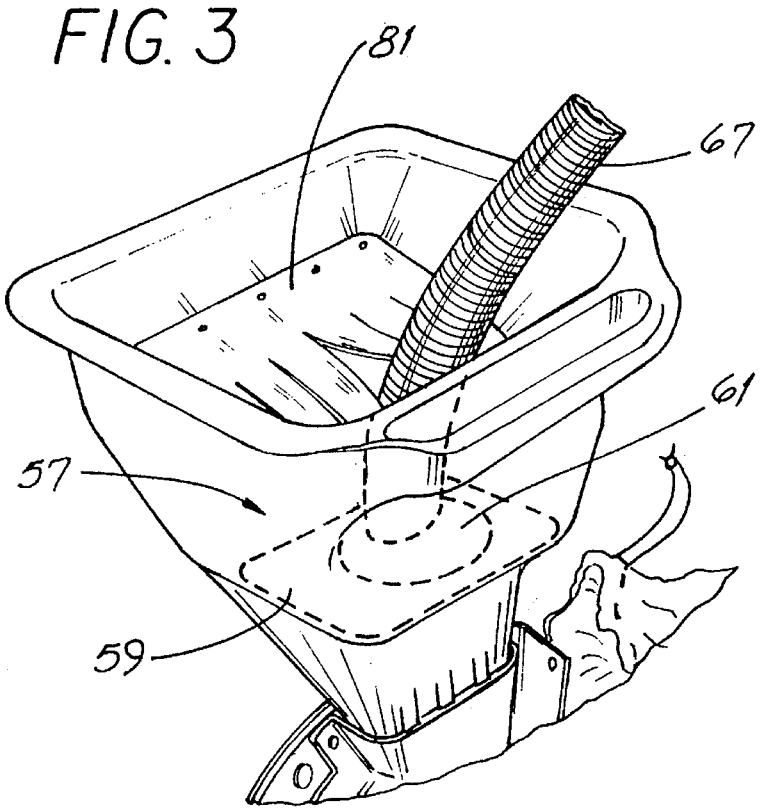
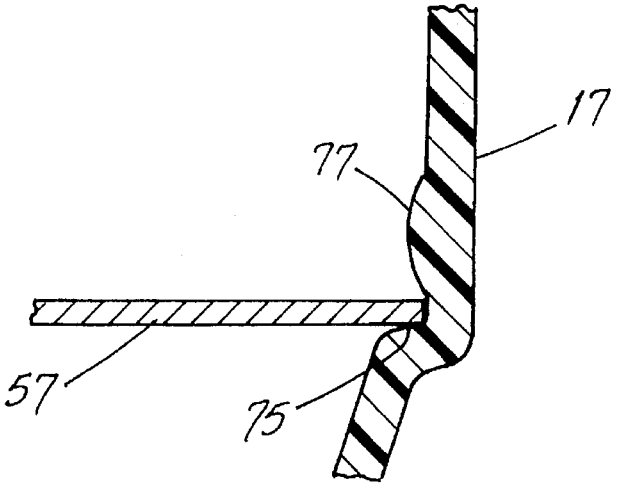
FIG. 5

FIG. 7
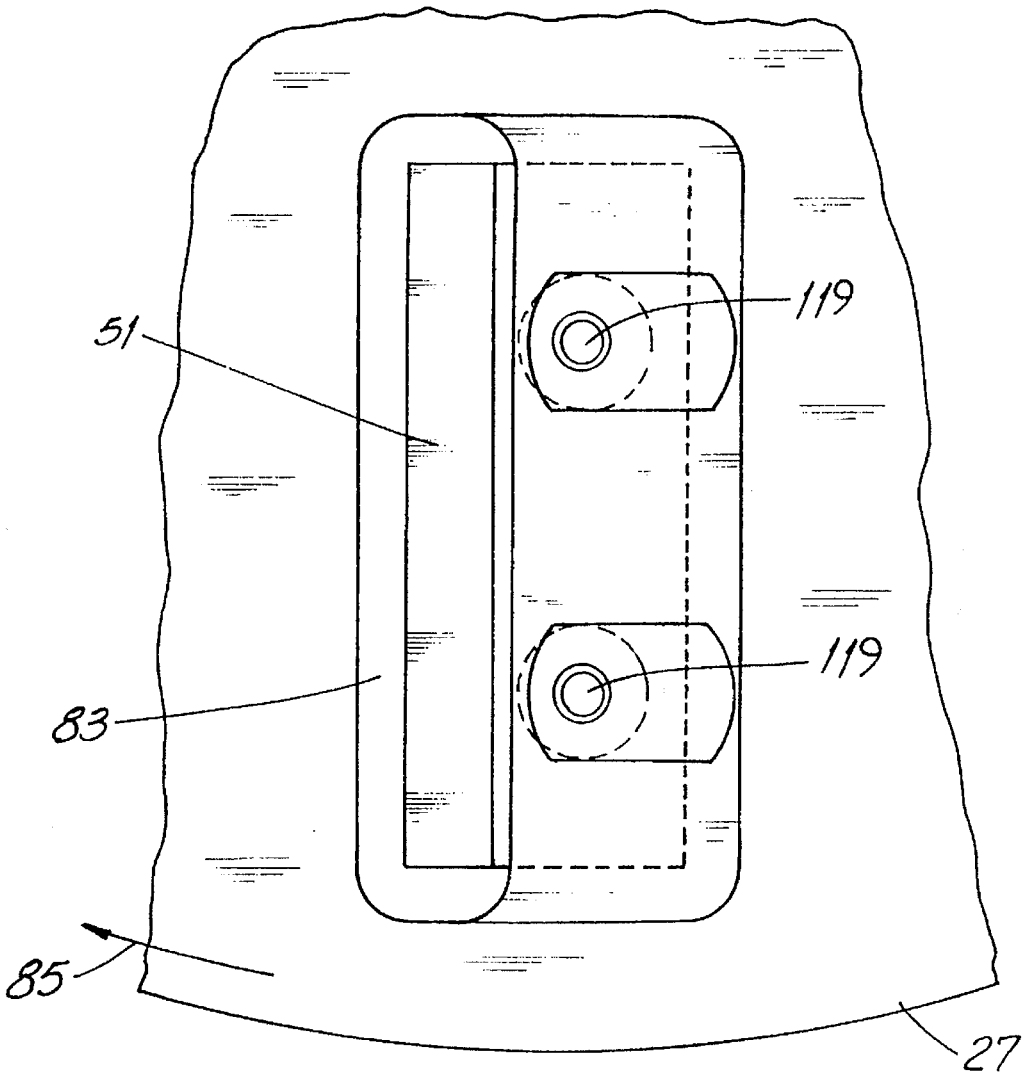
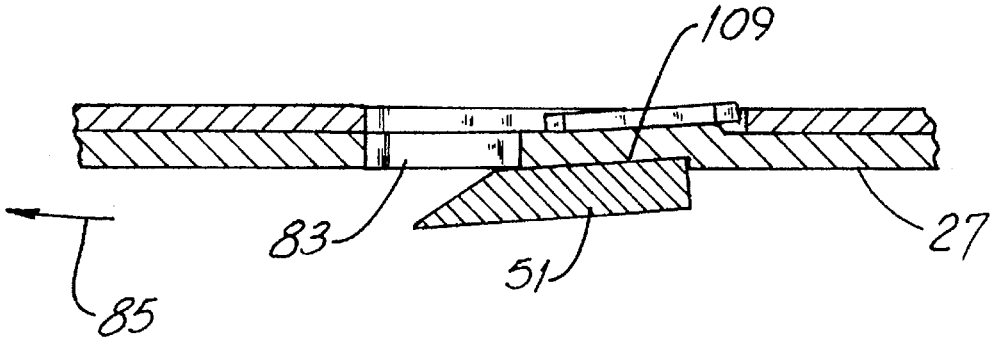
FIG. 8A

CHIPPER-SHREDDER WITH ENHANCED USER FEATURES

FIELD OF THE INVENTION

This invention relates generally to comminuting and, more generally, to comminution of lawn refuse such as grass clippings, leaves, tree branches and the like.

BACKGROUND OF THE INVENTION

Machines, often referred to as "chipper-shredders," have been in wide use for years for comminuting lawn and yard refuse. Owners of residential and commercial property use such machines to mulch grass clippings, small twigs and branches, leaves and the like. In the past, it had been common practice to place the comminuted refuse into bags and dispose of the bags and refuse in a landfill.

More recently, municipalities are becoming more concerned about the cost of procuring landfill space. A growing number of such municipalities prohibit many types of lawn refuse from being placed into a landfill. Consequently, chipper-shredder machines are increasing in importance since they reduce lawn refuse to small particle and "piece" sizes entirely suitable for use as garden, lawn and tree mulch. Chipper-shredder machines play an important part in returning valuable natural organic material, pulverized lawn refuse, to the soil.

There are number of manufacturers of such chipper-shredder machines and the patent literature illustrates several different machine configurations. Examples of such machines are shown in U.S. Pat. Nos. 5,156,345 (Baker); 5,102,056 (Ober); 5,018,672 (Peck); 4,875,630 (Carlson); 4,824,034 (Baker); 4,544,104 (Carlsson); 3,817,462 (Hamlin); 3,712,353 (Ferry) and others. While such machines have been generally satisfactory for their intended purpose, they are characterized by certain disadvantages.

For example, some models of chipper-shredders are driven by an electric motor, the torque-speed curve of which differs quite dramatically from that of a gasoline engine. And for chipper-shredders used by homeowners for residential applications, the machine must operate from a 15 A, 120 volt, single phase circuit. The fan and comminuting assembly of an electrically-powered machine is sized to be compatible with the motor. And when such assembly is steel—as is the case with known machines—the assembly diameter and mass are reduced for electric motor drive.

The resulting disadvantage is that the linear velocity and inertial energy of the comminuting knives decreases. The machine simply does not perform as well. And will a fan and comminuting assembly of decreased diameter, air flow rate is decreased.

Another disadvantage of known machines is that when they clog (as they will if abused by the user and sometimes do in any event), they are very difficult to unclog. Sometimes the user is required to (or believes he is required to) insert a tool of some sort into the fan and/or chipping chamber to try to get the fan and comminuting assembly to turn freely again.

Yet another disadvantage involves the fact that the designers of such machines have not fully appreciated the damage to the machine that might occur if internal parts break, e.g., if a knife flies off of the rotor or if the rotor breaks up. Nor have they appreciated how to minimize damage (and particularly damage to the prime mover) in the event of such a failure.

Another disadvantage is that designers of prior art machines have not yet fully appreciated the advantages of maximizing air flow out of the machine. High air flow helps "throw" chipped debris into a bag or the like and helps prevent clogging.

A chipper-shredder with enhanced user features addressing the above and other disadvantages would be an important advance in the art.

OBJECTS OF THE INVENTION

It is an object of the invention to provide an chipper-shredder with enhanced user features which overcomes some of the problems and disadvantages of the prior art.

Another object of the invention is to provide an improved chipper shredder which is compatible with an electric motor prime mover.

Another object of the invention is to provide an improved chipper shredder which can be driven by an electric motor and yet maintain high knive velocity and inertial energy for good comminuting.

Yet another object of the invention is to provide an improved chipper shredder which can be driven by an electric motor and yet maintain high air flow rate.

Another object of the invention is to provide an improved chipper shredder having a feature easily available to clear machine clogging.

Still another object of the invention is to provide an improved chipper shredder configured to minimize internal machine damage (including damage to the prime mover) if the machine is abused or operated grossly negligently which almost certainly will cause failure.

Another object of the invention is to provide an improved chipper shredder having a distinctive, easily-recognizable appearance. How these and other objects are accomplished will become more apparent from the following descriptions and from the drawing.

SUMMARY OF THE INVENTION

The new chipper-shredder machine has a number of features selected with the user in mind. For example, such machine includes a laminated lightweight fan and comminuting assembly to accommodate the speed-torque characteristics of an electric drive motor. And the assembly drive shaft has exposed wrench "flats" for reverse-rotating such assembly to remove clogging obstructions.

In recognition of the possibility of user abuse or negligence which might cause breakage of grinding rotor parts, such rotor is arranged and configured to direct broken parts away from the machine prime mover and toward the fan chamber. And the machine fan discharge port has increased area for improved air flow and reduced clogging. A few details regarding each innovation are set forth below.

This part of the summary deals with the laminated fan and comminuting assembly in a machine equipped with an assembly having first and second plates in laminar arrangement. The first and second plates are made of first and second materials, respectively, and the second material, preferably aluminum, has a density less than about 3 grams per cubic centimeter. The resulting assembly is light weight and suitable to be driven with an electric motor.

Preferably, the assembly also has a third plate and the first, second and third plates are in laminar arrangement and secured together with, e.g., with rivets. In one arrangement, the first plate and the third plate are made of the first material. Such material has a density in excess of about 6 grams per cubic centimeter and is preferably steel. The first and third plates are attached to the drive shaft by welding or other suitable means.

It is well recognized that chipper-shredder machines can become clogged if used improperly. In the improved machine, the main machine shaft has a shaft end extending through the fan chamber portion. The end has a structure integral thereto for "reverse-rotating" the shaft (rotating such shaft in a direction opposite normal rotation) using a tool such as a wrench. Turning the shaft (and the components attached thereto) backwards often aids unclogging of the machine.

More specifically, the structure includes first and second notches having first and second tool engagement surfaces, respectively. Such surfaces extend generally parallel to the axis of rotation, are generally parallel to one another and are spaced generally equidistant from the axis of rotation.

It is also recognized that if the machine is abused, parts of its grinding rotor may become detached and fly into the prime mover or stay inside the machine and cause more damage. The new machine has first and second spaced rotor plates and the first rotor plate has a "bending point" significantly less than that of the second rotor plate. Such first rotor plate is between the fan chamber and the more rigid second rotor plate.

In a highly preferred embodiment, the rotor plates are made of the same material, e.g., steel, but have differing thicknesses. More specifically, the first rotor plate has a thickness significantly less than that of the second rotor plate and, thus, the first plate bends more readily than the second plate.

In a less preferred embodiment, the first and second rotor plates are made of first and second materials, respectively, and the first material is softer than the second material. Such softer material makes the first plate more susceptible to bending. In either embodiment and if parts such as grinding knives come detached inside the machine, the first rotor plate bends in such a way (and, very likely, becomes detached from the studs) that such parts are permitted to move into the fan chamber and are directed away from the prime mover. From the fan chamber, such parts exhaust into a bag rather than remain in the machine to cause further damage.

Other aspects of the invention relate to an innovative configuration for the fan discharge path. Such duct-like path extends between the fan chamber and the discharge port and has a first dimension measured generally parallel to the axis of rotation of the machine shaft. The first dimension progressively increases from the chamber to the port so that the cross-sectional area of the discharge path similarly increases from the chamber to the port.

The discharge path also has a second dimension, such dimension being measured at an angle, e.g., 90°, to the first dimension. The second dimension also progressively increases when considering the path dimensions from the chamber toward and to the port. In other words, the cross-sectional area of the discharge path increases simultaneously in each of two dimensions.

The discharge path has an inlet portion in communication with the fan chamber which has a chamber wall. The discharge path has a path wall and the chamber wall and the path wall are generally coextensive at the inlet portion. That is, such walls "blend together" at the path inlet portion. However, the path wall gradually angles outward as the path approaches the discharge port and such path wall is spaced from the chamber wall at the discharge port.

With the aforementioned construction, the discharge path is bounded by an edge of demarcation separating the path from the fan chamber. The discharge path is visually distinct from the fan chamber and, in fact, the machine per se is visually distinctive because of the aforementioned construction.

Further details of the invention are set forth in the following detailed description and in the drawing.

BRIEF DESCRIPTION OF THE DRAWINGS

FIG. 3 is a more detailed view of aspects of the hopper of the machine of FIG. 1.

FIG. 5 is a section view of a portion of the machine hopper and of a vacuum hose adapter mounted therein.

FIG. 7 is an enlarged elevation view of a portion of the chipper plate, an opening therethrough and a chipping knife mounted thereon. Parts are broken away.

FIG. 8A is a cross-section edge view of the plate and knife of FIG. 7 and also showing the fan plate and a weld nut used to secure the knife to the plate. Parts are broken away.

DETAILED DESCRIPTION OF PREFERRED EMBODIMENTS

Figure 1:
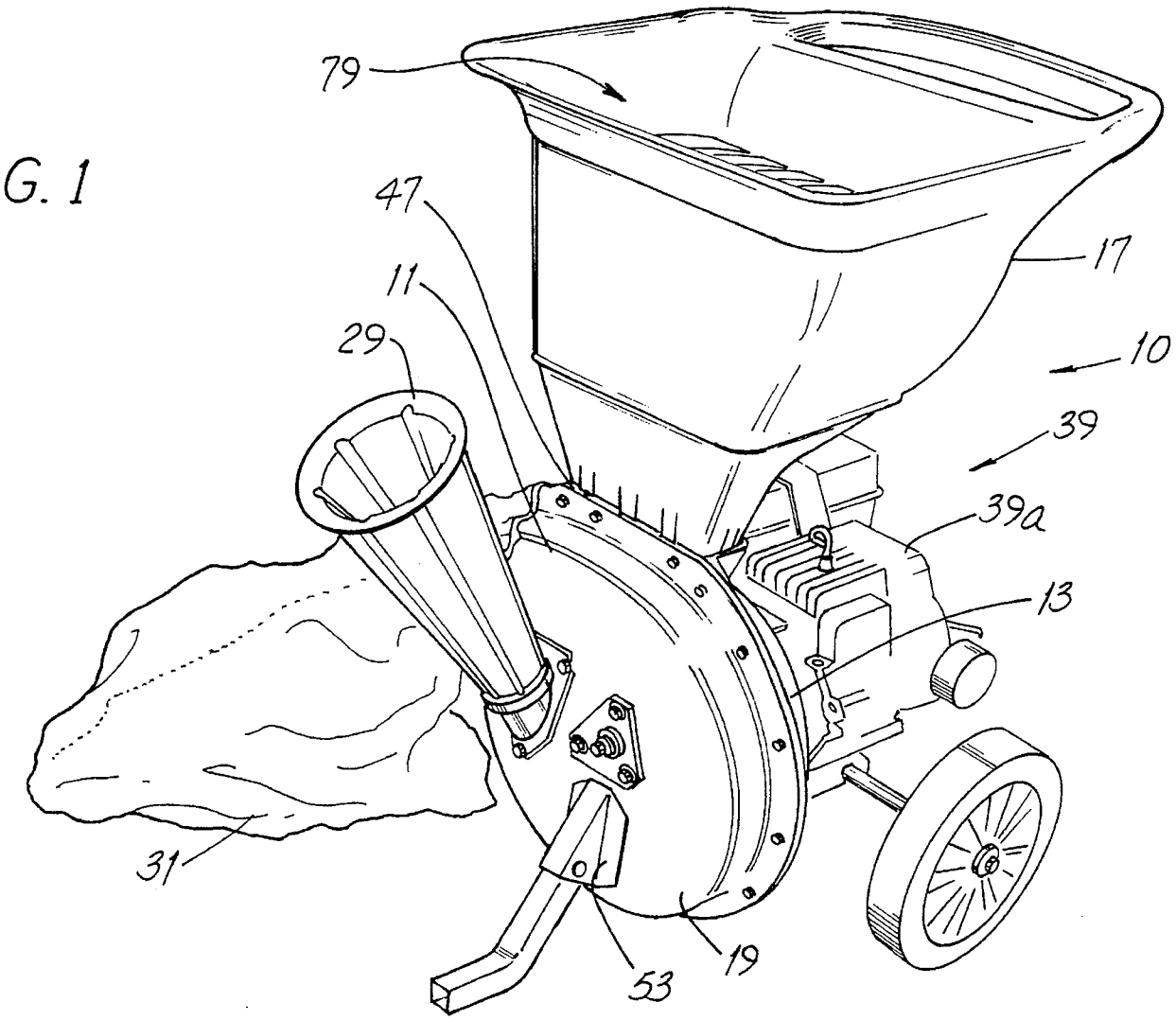
FIG. 1 is a perspective view of the new chipper-shredder machine.

Before setting forth details of the new chipper-shredder machine 10, a general description is provided. Referring to FIGS. 1, 2, 6 and 10, the machine 10 includes a housing 11 having a grinding chamber portion 13 with a smooth, curved interior wall 14. Such portion 13 confines parts of a fan and comminuting assembly 15 for "processing," i.e., comminuting, lawn refuse fed into the housing 11 through the hopper 17. The housing 11 also has a fan chamber portion 19 in which is confined other parts of the assembly 15 including a fan 21 functioning as a centrifugal blower. Such blower creates a vacuum (in the grinding chamber portion 13 which, in effect, is the fan inlet), draws refuse into the housing 11 and provides (at the fan discharge port 23) a pressurized air stream which ejects such processed refuse. The plate 25 embodying the fan 21 is "back-to-back" with a chipper plate 27 which "chips" larger branches fed into the housing 11 through a tube 29 described below. A bag 31 is attached to the fan discharge port 23 to catch such refuse for later disposal.

A generally L-shaped mounting bracket 33 is attached to that side of the housing 11 defining the grinding chamber portion 13 and has a pair of openings receiving a cross axle 35 to which are mounted a pair of wheels 37. A "prime mover" 39 (either an internal combustion engine **39*a*—illustrated—or an electric motor) is mounted to the bracket platform 41 and has its center of gravity 43 approximately vertically above the axle 35. This arrangement makes it very easy to tip the machine 10 rearward toward the prime mover 39 by grasping the handle 45 formed on the edge of the hopper 17. The machine 10 can then be wheeled from place to place. And the prime mover 39 is mounted very low on the machine 10** for better resistance against accidental tipover.

Referring also to FIGS. 7 and 8A, a receptacle-like hopper 17 is attached to an inlet port 47 on that side of the housing 11 defining the grinding chamber portion 13 for receiving refuse and directing it downward toward the grinding blades 49. Attached to the fan chamber portion 19 of the housing 11 is a cone-shaped tube 29 for receiving larger branches and directing them to a chipper plate 27. Such plate 27, which has several knives 51 mounted on it, "slices" the branches into small chips. Such chips are then expelled from the fan discharge port 23.

Figure 9:
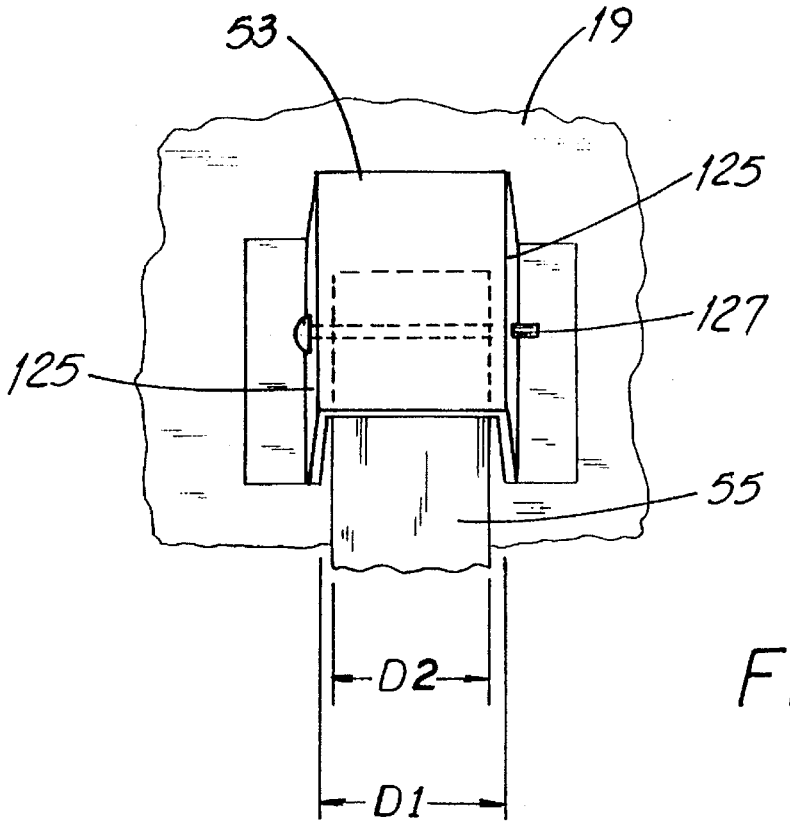
FIG. 9 is an elevation view of the strut and strut mounting bracket shown in FIGS. 1 and 2. Parts are broken away.

Referring also to FIG. 9, a strut mounting bracket 53 is secured to the outer surface of the fan chamber portion 19 of the housing 11 and supports a ground-contacting strut 55 when the machine 10 is in use. That is, the machine 10 normally rests on the two wheels 37 and on the strut 55.

Figure 2:
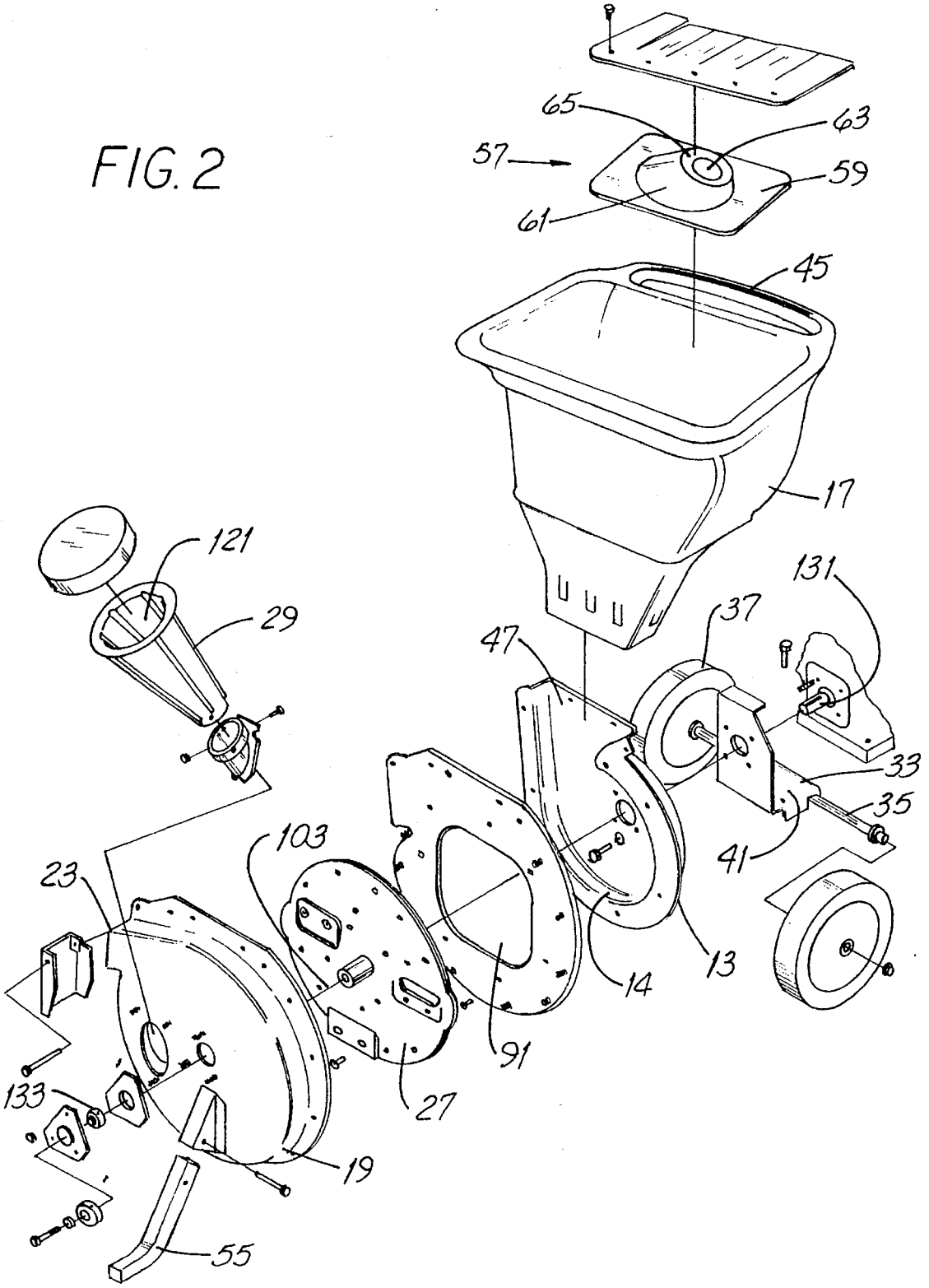
FIG. 2 is an exploded view of the machine of FIG. 1.
Figure 4:
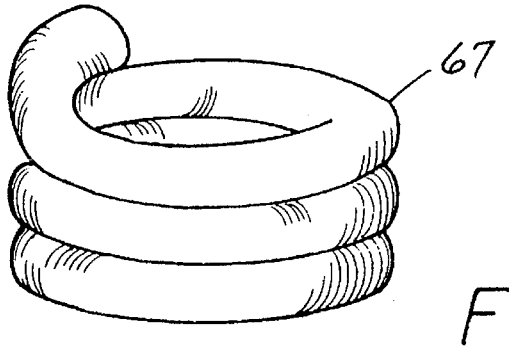
FIG. 4 is a perspective view of exemplary vacuum hose useful with the machine of FIG. 1.
Figure 11:
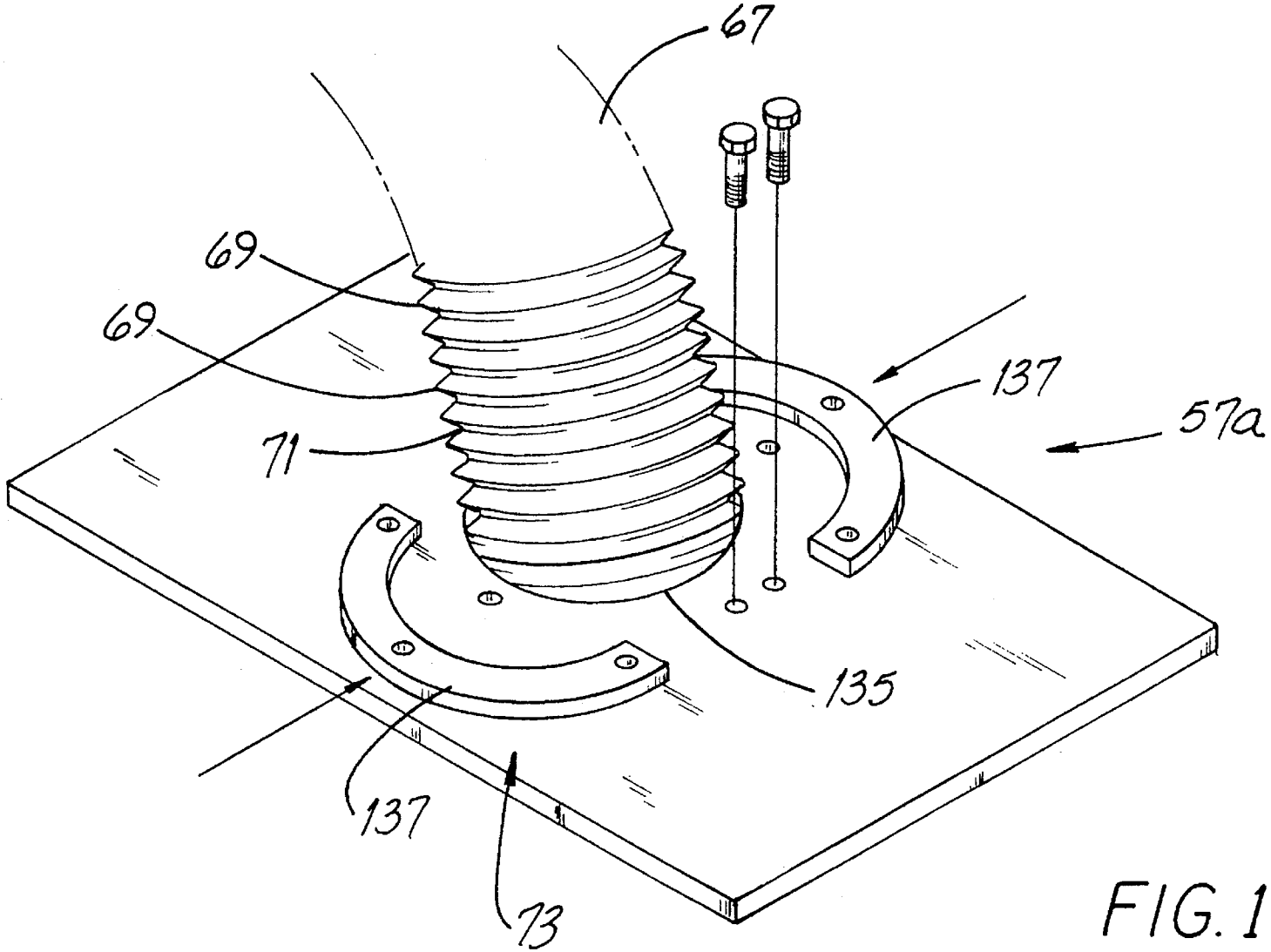
FIG. 11 is a perspective view of an alternate embodiment of a vacuum adapter plate.

A more detailed description of aspects of the new chipper-shredder machine 10 will now be set forth. Referring to FIGS. 2, 3 and 11, the machine 10 includes a unique metal or plastic vacuum adapter 57 having a rectangular flange 59 from which protrudes a rounded boss 61 having a circular opening 63. Fitted to the perimeter of the opening 63 is a resilient ring-like collar 65, the inside aperture diameter of which is selected in view of a diameter of the vacuum hose 67 depicted in FIG. 4. A suitable adapter 57, made for an entirely different purpose, is available from Oatey Company and is known as its "NO-CALK" roof-mount fitting.

Preferably, such hose 67 comprises a length of irrigation or drainage hose which includes a plurality of spaced circumferential ribs 69. The diameter of the collar aperture is preferably selected to be somewhat less than the smallest outside diameter of the hose 67. Such hose 67 is thereby readily urged into the collar 65 and well retained by the collar 65 which "seats" in a groove 71 between a pair of ribs 69 and seals around the hose 67. However, the hose 67 can turn within the collar 65. An alternate embodiment of a vacuum adapter **57*a* using a hoop-like C-clamp device 73 is described below in connection with FIG. 11**.

There are at least four important benefits from the arrangement described above. One is that the hose 67 can be attached to and removed from the adapter 57 without the use of tools. Another is that since the hose 67 extends nearly vertically out the top of the hopper 17, the hose 67 is readily pivoted to "point" in any direction 360° around the machine perimeter. One does not need to "dedicate" a substantial length of hose 67 merely to get its distal end to that side of the machine 10 where it is used as a vacuum wand to pick up leaves, other lawn refuse, etc.. In contrast, consider the side-mounted hose arrangement shown in the aforementioned Peck et al. patent.

A third benefit is that, as described below, the adapter 57 itself can be quickly attached and removed without the use of tools. A fourth benefit is that the hose 67 and the adapter 57 are mass-produced, relatively-low-cost products (made for disparate purposes) and this has important implications for reducing the cost of the machine 10.

Referring further to FIGS. 2 and 3 and also to FIG. 5, the hopper 17 has a shoulder 75 extending at least partially around its interior perimeter. The adapter 57 is retained on the hopper 17 in shoulder-abutting relationship so as to seal well against the shoulder 75. Adapter retention is preferably by at least one bump-like projecting member 77 (and preferably several such members 77) molded into the inner surface of the hopper 17 and positioned adjacent to but spaced slightly from the shoulder 75. Whether being mounted or removed, the adapter 57 is readily urged over the members 77 and "snapped" into or out of the hopper 17 without the use of tools.

Whether or not the vacuum adapter 57 and hose 67 are used, the mouth 79 of the hopper 17 is obstructed by a multi-fingered guard 81 attached near one edge of the hopper 17. The guard helps prevent debris from being projected out of the hopper 17 and also discourages insertion of a hand or arm into the hopper 17 and, possibly, into the grinding portion.

Considering FIGS. 2, 6, 7 and 8A, the machine 10 has a wheel-like comminuting and fan assembly 15 which rotates within the housing 11 at relatively high speed. Such assembly 15 includes a generally planar chipper plate 27 having plural openings 83. A chipping knife 51 is attached adjacent to each opening and as indicated by the arrows 85, rotation of the assembly 15 is in a direction so that branches and the like fed into the machine 10 through the tube 29 are "sliced" bologna-style into small chips, whereupon such chips are blown out the discharge port 23. The knives 51 are mounted in a unique way explained below in connection with a further discussion of FIGS. 7 and 8A, 8B and 8C.

Back-to-back with the chipper plate 27 is a generally planar fan plate 25 having outwardly-bent blades 87. The plates 25, 27 are attached to one another by bolts, rivets 89 or the like. The blades 87 produce air flow which urges material being comminuted in the grinding chamber portion 13 to "migrate" through the opening 91 in the divider plate 93 and be blown out the discharge port 23. And of course, chips cut from limbs by the knives 51 are also blown out. It is to be appreciated that the chipper plate 27 and the fan plate 25 are in the fan chamber portion 19 of the housing 11.

In one embodiment configured for use with a gasoline engine **39*a* as a prime mover 39, the plates 25, 27 are both steel. In another embodiment configured for use with an electric motor as a prime mover 39, the chipper plate 27** is fabricated of aircraft-quality aluminum plate for reduced weight.

The fan plate 25 and fan chamber portions 19 are cooperatively sized and configured to provide what is generally known as a scroll-type centrifugal blower. On its suction side, such blower creates negative pressure by drawing in air (with or without entrained refuse) through the inlet port 47 and on its discharge side, creates positive air pressure at the discharge port 23.

The assembly 15 also has an extending boss 92 to which is attached a pair of generally cloverleaf-shaped grinding rotors 94, neither of which is in the fan chamber portion 19. Each rotor 94 has several radially outwardly extending lobes 95 and a stud 97 extends between the corresponding lobe 95 of each rotor 94 for mounting a free-swinging comminuting blade 49. That is, each blade 49 is free to swing 360° about the stud long axis.

Each blade 49 has a blade body 99 coincident with a plane 101 (such plane 101 being normal to the axis of rotation 103) and also has a pair of comminuting fingers 105 extending from the body. One finger **105*a* is substantially coincident with the plane 101 and the other finger 105*b* is bent away from the plane 101. And the fingers 105 are spaced apart by a slot 107. An advantage of this type of blade 49 is that, unlike the blades depicted in the Fortney and Reschke patents mentioned above, twigs and similar refuse are less likely to get caught between the blade fingers 105** and simply be carried around by a blade rather than being comminuted thereby.

It is to be appreciated that neither grinding rotor 94 nor the blades 49 are in the fan chamber portion. And, preferably, the opening 91 is a square with rounded corners; no inwardly-protruding scallop-like edges are included or necessary.

Referring to FIGS. 2, 7, 8A, 8B and 8C, the seat 109 for the chipper knife 51 is formed in a unique way that results in very little added manufacturing cost above that incurred to attach the fan plate 25 and the chipper plate 27 to one another. Attachment of the plates 25, 27 is preferably by rivets 89, one of which is shown in its undeformed configuration in FIG. 8B. The plates 25, 27 and the rivet 89 therethrough are rested on a platen 111 and impacted by a rivet setting tool, not shown.

Figure 8C:
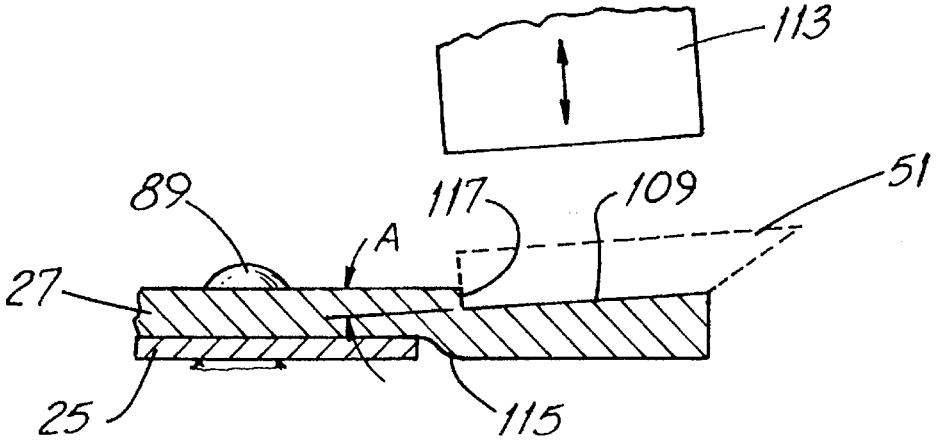
FIG. 8C is an inverted view generally like that of FIG. 8B and showing the chipper plate and the rivet subsequent to securement by rivet deformation. Also shown is a knife-receiving pocket formed simultaneously with securement.
Figure 8B:
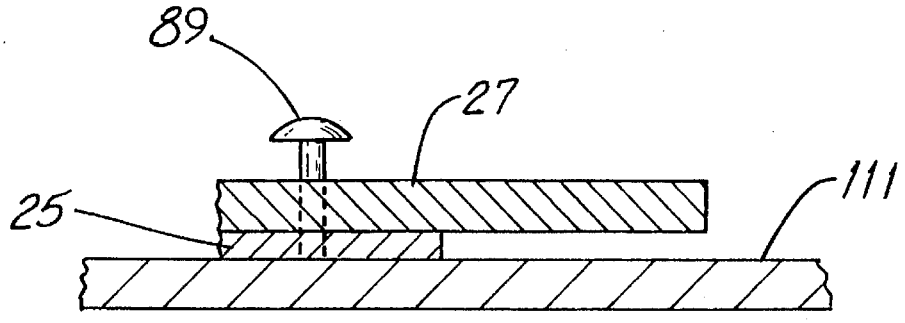
FIG. 8B is an inverted view generally like that of FIG. 8A and showing the chipper plate and an attaching rivet prior to securement.

Simultaneously, a sharp-shouldered seat forming tool 113 impacts the chipper plate 27 and upset-forms the surface thereof to define a pocket-like knife-receiving seat 109. The seat 109 is at an angle "A" of about 2°–3° with the surface of the chipper plate 27 to provide what is known as "back relief" to the knife. As the chipper plate 27 is upset formed, its opposing surface 115 bulges outward as shown in FIG. 8C.

A significant aspect of the foregoing is that no metal is removed from the chipper plate 27; rather, such metal is deformably upset. The ledge 117 resulting from such operation provides a bearing surface which "backs up" the knife 51 during chipping operations. This back-up feature (which is known per se) helps avoid straining and shearing the bolts 119 holding the knife 51 to the plate 27.

Referring again to FIG. 2, a tapered, cone-like tube 29 is coupled to the fan chamber portion 19 of the housing 11 for directing tree branches toward the chipper plate 27. The tube 29 includes a branch-receiving mouth 121 and the machine 10 has a fully removable disc-like closure 123 for sealing the mouth 121 when lawn refuse is flowing through the hose 67 or is being otherwise fed in through the hopper 17. When the tube 29 is so sealed, the vacuum capability of the machine 10 is increased and the adapter-attached hose 67 does a better job of picking up lawn refuse. In a highly preferred machine 10, the closure 123 is sized and shaped to fit a commercially-available frozen food container and is available from a vendor of such containers. One exemplary closure is from a plastic, tub-like ice cream container.

Referring now to FIGS. 2 and 9, it will be recalled that the new machine 10 has a substantially-reduced tendency to dance or walk on a hard surface during use. A feature believed to be responsible for this characteristic involves a scoop-shaped strut mounting 53 bracket attached to the fan chamber portion 19 of the housing 11. The bracket 53 includes a pair of support members 125 which are spaced by a first dimension "D1." The strut 55 is attached to the bracket 53 by a pin 127 and, preferably, has a width second dimension "D2" no more than about 95% of the first dimension "D1." While not wishing to subscribe to any particular theory as to why this arrangement helps reduce vibration, it is believed that housing vibration is significantly isolated from the strut 55 because of the strut-bracket spacing.

Figure 10:
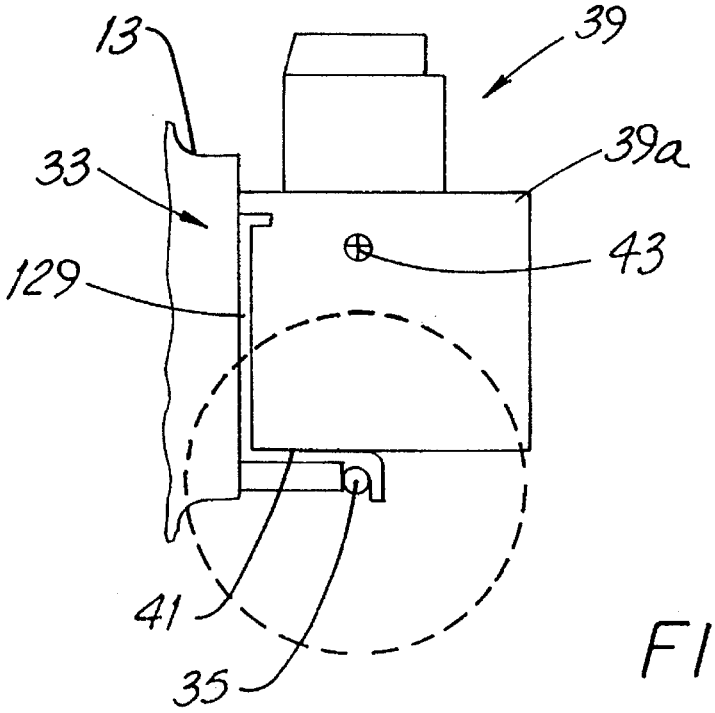
FIG. 10 is a side elevation view showing the relative location of the prime mover center of gravity and the wheel axle.

As depicted in FIGS. 2 and 10, a generally L-shaped prime mover mounting bracket 33 has its vertical panel 129 attached to the grinder portion 13 of the housing 11. The bracket platform 41 extends away from such portion 13 and has a machine-supporting axle 35 mounted to it. A prime mover 39, e.g., an internal combustion engine **39*a*, has a center of gravity 43 substantially vertically above the axle 35. And such center of gravity 43 is relatively closely spaced to the axle 35. The former feature permits the machine 10 to be readily tipped and wheeled "cart fashion" to a new location using the convenient handle 45. The latter feature improves machine stability in that the machine 10** is not "top heavy."

There is another factor which undoubtedly contributes to the fact that the machine 10 is relatively immobile in use, even on a hard surface. The prime mover drive shaft 131 (which powers the comminuting and fan assembly 15) extends through the housing 11 and is supported at its distal end by a bearing 133 in the fan portion 19 of the housing 11. This arrangement substantially avoids the shaft "whip" which often attends a cantilevered shaft (a shaft supported at only one end) rotating slightly unbalanced loads.

FIG. 11 illustrates an alternate embodiment of a vacuum adapter plate **57*a* which is sheet-like, generally planar and has an opening 135 through it sized to receive the end of a hose 67. Two C-brackets 137 are attached to the plate 57*a* and when so attached, they seal against the hose 67 between a pair of ribs 69**.

The embodiment of FIG. 11 offers the benefits of good vacuum seal against the hose 67, easy 360° pivoting rotation of the hose 67, easy attachment to and removal from the hopper 17 (in the same way as described above) and inexpensive manufacturing cost. The hose 17 is attached by minimal use of tools and once attached, need only rarely be removed.

Figure 12:
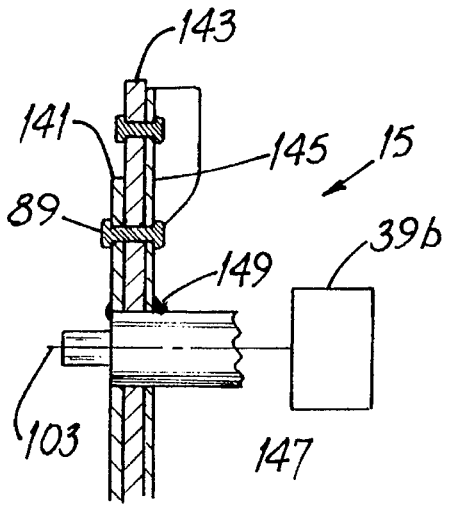
FIG. 12 is a side elevation view, partly in cross-section of the laminated fan and comminuting assembly. Parts are broken away.

The new chipper-shredder machine 10 has a number of features selected with the user in mind. Referring to FIG. 12, such machine 10 includes a laminated lightweight fan and comminuting assembly 15 particularly configured to accommodate the speed-torque characteristics of an electric drive motor 396. The assembly has first (or chipper), second and third plates 141, 143, and 145, respectively, and such plates are arranged in a "side-by-side" laminated arrangement.

The first and second plates 141, 143 are made of first and second materials, respectively, and the second material, preferably aluminum, has a density less than about 3 grams per cubic centimeter. The first and third plates 141 and 145, respectively, are made of the same material, e.g., steel, which has a density in excess of about 6 grams per cubic centimeter.

It is to be appreciated that the second and third plates 143, 145 are of about the same diameter and the first plate 141 has a diameter substantially less than that of the other two plates 143, 145. All of the plates 141, 143, 145 are secured together by rivets 89 and the first and third plates 141, 145 are attached to the machine shaft 147 by any suitable means such as welds 149.

By using laminated construction and a second plate 147 made of lightweight metal, the diameter of the assembly 15 can be increased over that possible using all-steel construction and still not overload the electric motor 396. And since the knives 51 are maximally spaced from the axis of rotation 103, their linear velocity and inertia are high and chipping performance is improved. And a larger diameter fan plate 145 helps provide more air flow.

Figure 13:
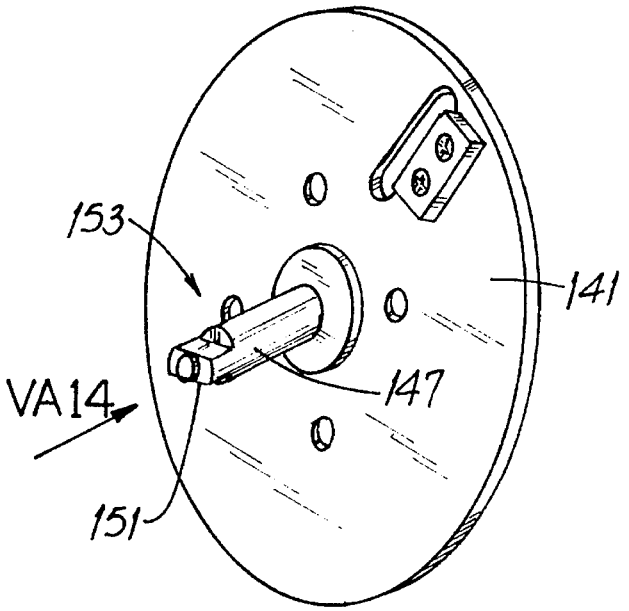
FIG. 13 is a perspective view of the machine shaft and the shaft end, both shown in conjunction with a fan and comminuting assembly.
Figure 14:
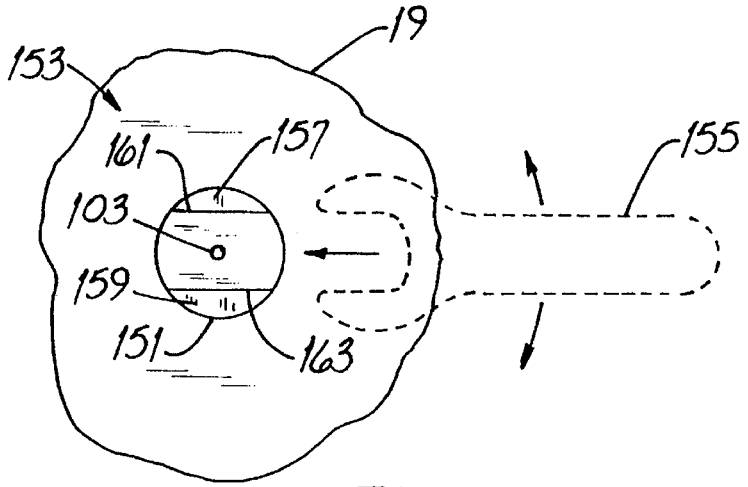
FIG. 14 is an elevation view of the end of the machine shaft taken along the viewing axis VA14 of FIG. 13 and showing the sheet metal fan chamber portion. Parts are broken away and a wrench is shown in dashed outline.

Referring now to FIGS. 13 and 14, chipper-shredder machines like machine 10 can become clogged and jam to the point of stalling the prime mover 39 if used improperly. In the improved machine, the main machine shaft 147 has a shaft end 151 extending through the fan chamber portion 19. The end 15 has a structure 153 integral thereto for turning the shaft 147 backward using a tool such as a wrench 155. Turning the shaft 147 (and the assembly 15 and grinding rotor 93 attached thereto) backwards often helps to unclog the machine 10.

The structure 153 includes first and second right angle notches 157, 159, respectively, having first and second tool engagement "flats" or surfaces 161 and 163, respectively. Such surfaces 161, 163 extend generally parallel to the axis of rotation 103, are generally parallel to one another and are spaced generally equidistant from the axis of rotation 103.

Figure 15:
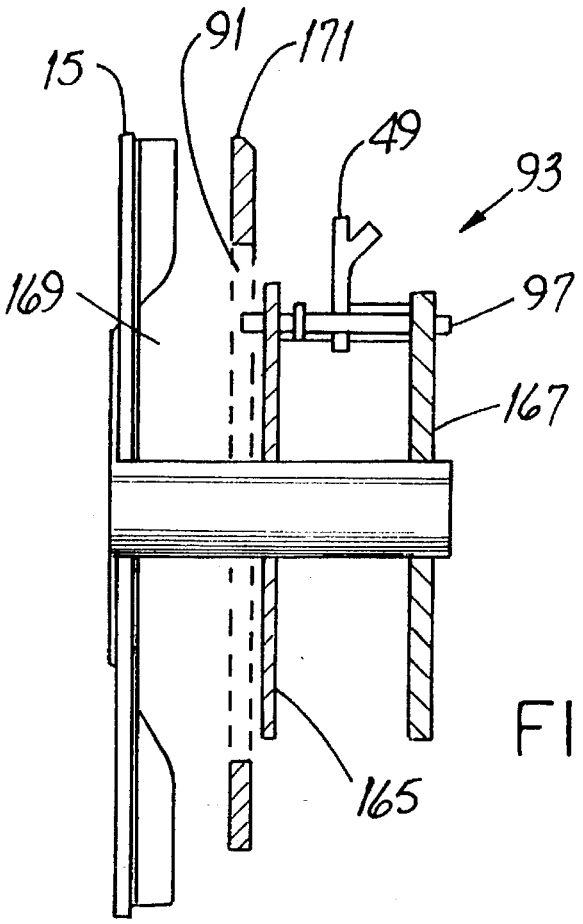
FIG. 15 is a side elevation view, partly in cross-section, of a first embodiment of the machine grinding rotor, shown with the supporting machine shaft and other machine components. Parts are broken away.
Figure 16:
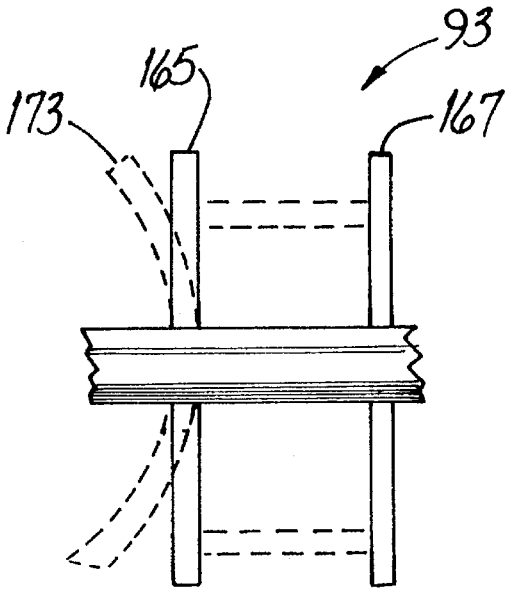
FIG. 16 is a side elevation view generally like that of FIG. 15 and showing a second embodiment of the machine grinding rotor. Parts are broken away and other parts are shown in dashed outline.

Referring next to FIGS. 15 and 16, the grinding rotor 94 has first and second spaced rotor plates 165 and 167, respectively, and the free-swinging grinding blades 49 are mounted on studs 97 between the plates 165, 167. The first rotor plate 165 will bend under significantly less force than that required to bend the second rotor plate 167.

In a highly preferred embodiment shown in FIG. 15, the rotor plates 165, 167 are made of the same material, e.g., steel, but have differing thicknesses. More specifically, the first rotor plate 165 has a thickness significantly less than that of the second rotor plate 167 and such reduced thickness imparts a characteristic of bending under a lower force than required to bend the second rotor plate 167.

In a less preferred embodiment shown in FIG. 16, the first and second rotor plates 165, 167 are made of first and second materials, respectively, e.g., aluminum and steel, respectively. The first material is softer than the second material and it is the relative softness of such material that makes it more susceptible to bending.

As best seen in FIG. 15, the first rotor plate 165 is between the fan chamber 169 and the more rigid second rotor plate 167 and is approximately aligned with the divider plate 171 in which the opening 91 is formed. If parts such as grinding knives 49 or studs 97 come detached inside the machine 10, the first rotor plate 165 bends "cup-like" to a position 173 approximating that shown in dashed outline in FIG. 16. Parts are thereby permitted to move into the fan chamber 169 and are directed away from the expensive-to-replace prime mover 39. From the fan chamber 169, such parts exhaust into a bag 31 rather than remain in the machine 10 to cause further damage.

Figure 17:
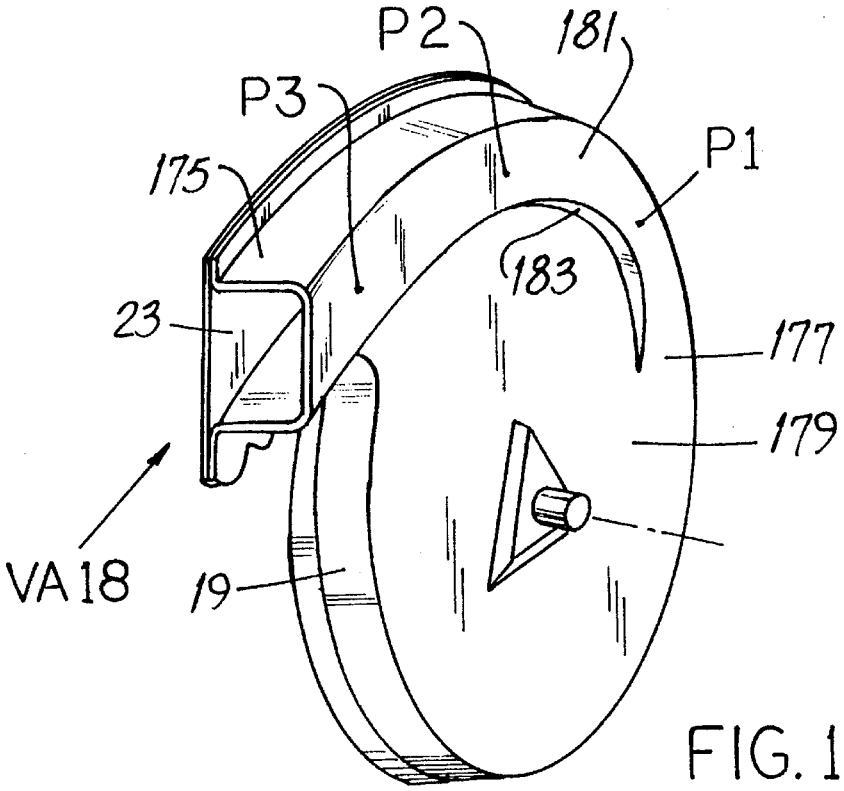
FIG. 17 is a perspective view of the fan chamber portion showing the new fan discharge path configuration.
Figure 18:
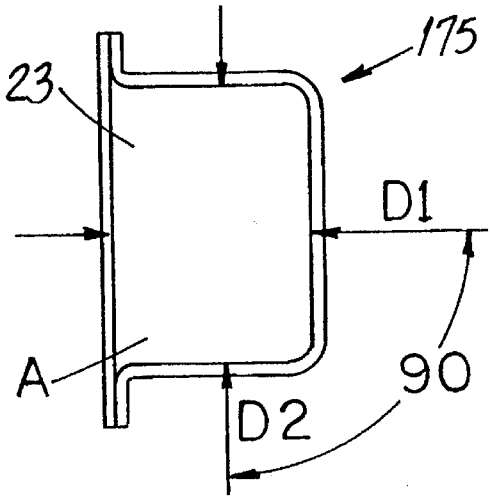
FIG. 18 is an elevation view of the discharge port taken generally along the viewing axis VA18 of FIG. 17.
Figure 2:
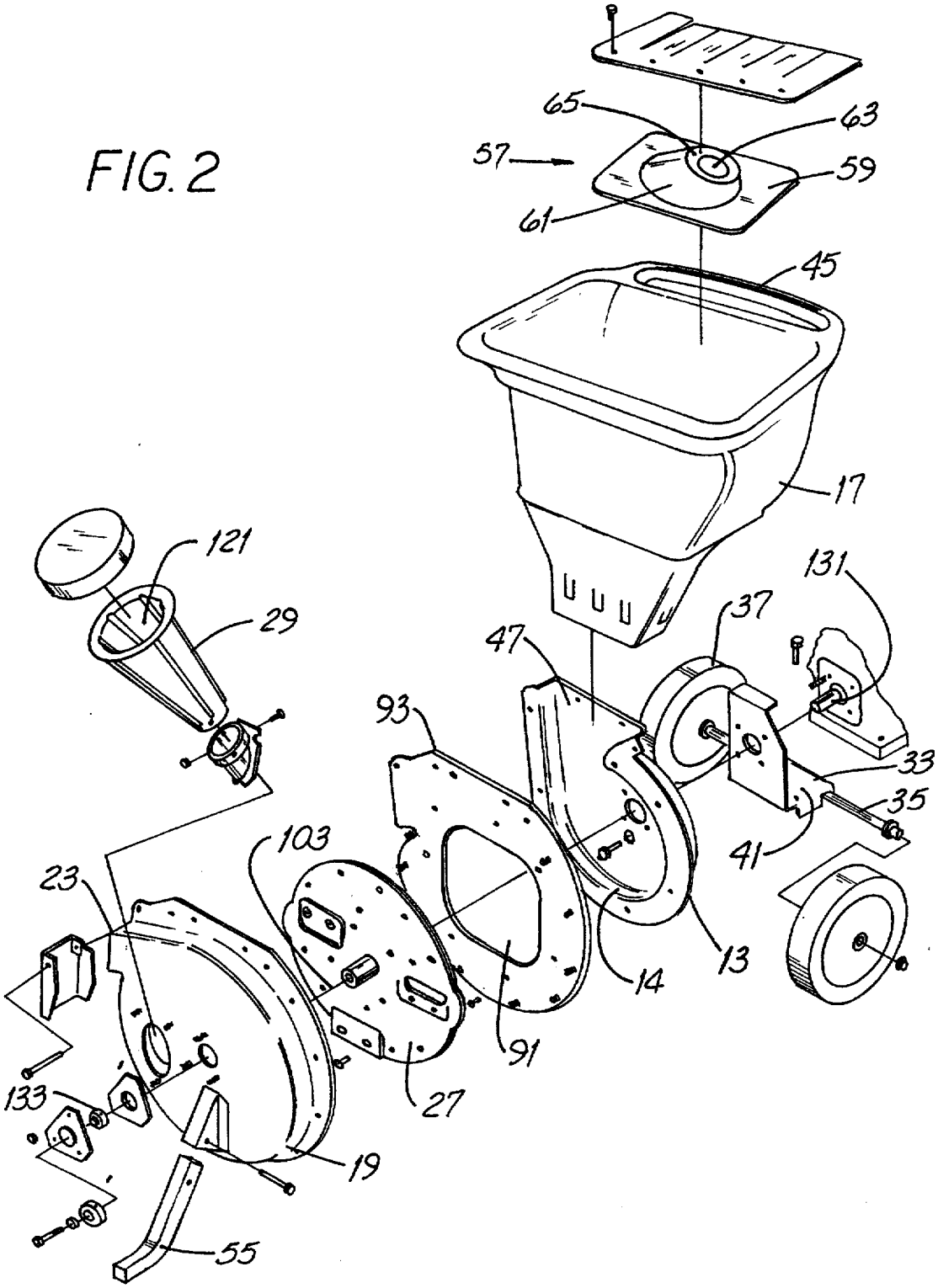
Figure 4:
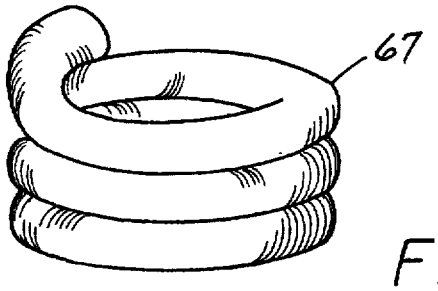
Figure 6:
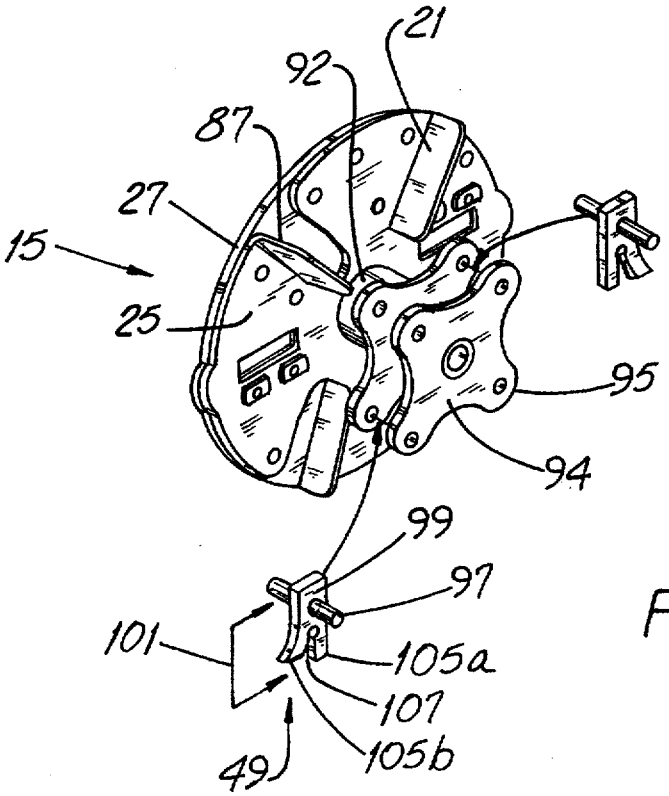

Referring next to FIG. 17 and 18, other aspects of the invention relate to an innovative configuration for the fan discharge path 175. Such curved, duct-like path 175 is defined in part by the sheet metal fan chamber portion 19 and extends between the fan chamber 169 (bounded in part by portion 19) and the discharge port 23. Such path 175 has a first dimension "D1" measured generally parallel to the axis of rotation 103 of the machine shaft 147. At points along the path such as points P1, P2 and P3 in that order, the first dimension "D1" progressively increases from the chamber 169 to the port 23 so that the cross-sectional area "A" of the discharge path 175 similarly increases from the chamber 169 to the port 23.

The discharge path 175 also has a second dimension "D2," such dimension being measured at an angle, e.g., 90°, to the first dimension "D1." The second dimension "D2" also progressively increases when considering the path dimensions from the chamber 169 toward and to the port 23 along the points P1, P2 and P3 in that order. In other words, the cross-sectional area of the discharge path 175 increases simultaneously in each of two dimensions "D1" and "D2."

Referring particularly to FIG. 17, the discharge path has an inlet portion 177 in communication with the fan chamber 169. Such chamber 169 has a chamber wall 179, the discharge path 175 has a path wall 181 and the walls 179, 181 and are generally coextensive at the inlet portion 177. That is, such walls 179, 181 "blend together" at the path inlet portion 177. However, the path wall 181 gradually angles outward as the path 175 approaches the discharge port 23 and such path wall 181 is spaced from the chamber wall 179 at the discharge port 23.

With the aforementioned construction, the discharge path 175 is bounded by a very-visibly-apparent edge of demarcation 183 visually separating the path 175 from the fan chamber wall 179. In fact, the machine 10 per se is visually distinctive because of the aforementioned construction.

While the principles of the invention have been described in connection with specific embodiments, it is to be understood clearly that such embodiments are exemplary and are not limiting.

What is claimed is:

1. In a chipper-shredder machine having (a) a housing with a fan chamber portion and a fan chamber wall and (b) a drive shaft extending toward the fan chamber portion and connected to a prime mover to be driven in a first direction for wood chipping, the improvement wherein:

the shaft has a shaft end extending through the fan chamber portion and external to the fan chamber wall; and the externally-exposed shaft end includes a structure integral to the end for unclogging the machine by rotating the shaft in a second direction using a tool.

2. The machine of claim 1 wherein:

the shaft has an axis of rotation;

the structure includes first and second notches having first and second tool engagement surfaces, respectively; and the tool engagement surfaces extend generally parallel to the axis of rotation.

3. The machine of claim 2 wherein the tool engagement surfaces are generally parallel to one another and are spaced generally equidistant from the axis of rotation.

4. In a chipper-shredder machine having (a) a fan chamber, (b) a fan rotating in the chamber about an axis of rotation and (c) a fan discharge port, the improvement wherein:

the chamber is bounded in part by a divider plate;

a fan discharge path extends between the chamber and the port;

the discharge path has a first dimension measured from the divider plate generally parallel to the axis of rotation;

the first dimension progressively increases from the chamber to the port;

the discharge path has an externally-exposed path wall angled with respect to the divider plate; and the discharge path is bounded by an externally-exposed edge of demarcation separating the path from the fan chamber.

5. The machine of claim 4 wherein:

the fan chamber is bounded in part by a chamber wall;

the chamber wall and the path wall are generally coextensive at the inlet portion; and the path wall is spaced from the chamber wall at the port.

* * * * *

UNITED STATES PATENT AND TRADEMARK OFFICE

CERTIFICATE OF CORRECTION

PATENT NO. : 5,603,459

DATED : February 18, 1997

INVENTOR(S) : Thomas W. Gearing and Andrew W. Haver

Figure 6:
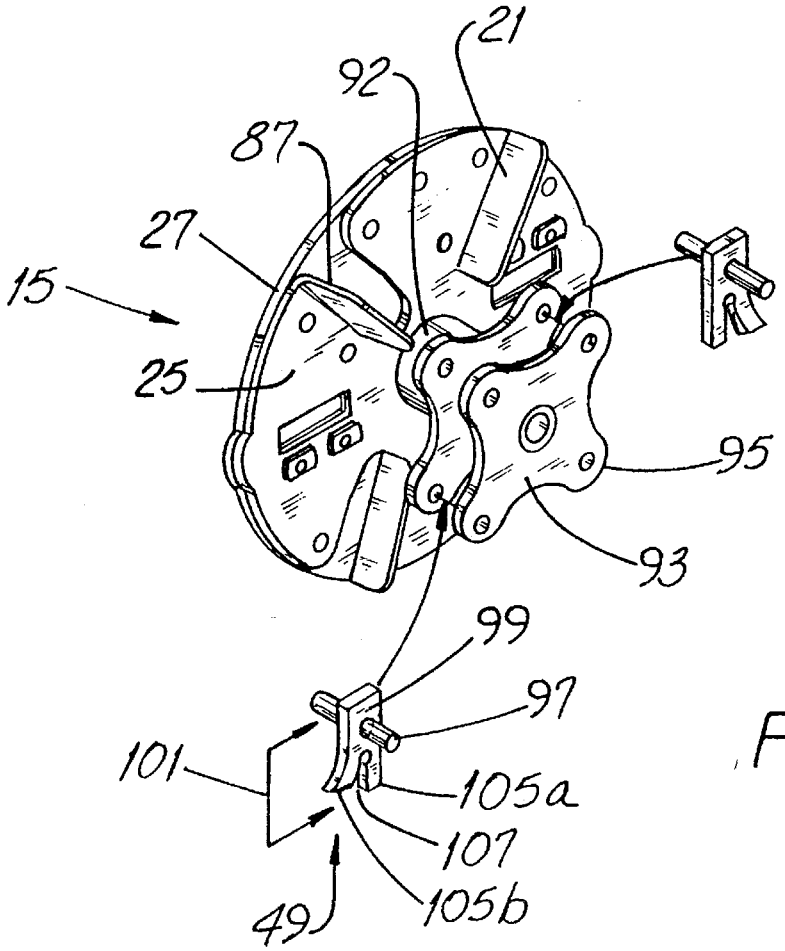
FIG. 6 is a partially-exploded view of the comminuting and fan assembly of the machine.

It is certified that error appears in the above-identified patent and that said Letters Patent are hereby corrected as shown below:

In FIGURES 2 and 6, the drawings are corrected to include the numerals 93 and 94, respectively (see the attached drawing sheets).

In column 8, line 65, delete "396" and insert --39b--.

In column 9, line 18, delete "396" and insert --39b--.

Signed and Sealed this

First Day of July, 1997

Bruce Lehman

*Attest:*

BRUCE LEHMAN

*Attesting Officer*

*Commissioner of Patents and Trademarks*